United States Patent [19]

Müller et al.

[11] 4,010,062

[45] Mar. 1, 1977

[54] METHOD OF AND APPARATUS FOR SPLICING THE ENDS OF FILM STRIPS

[75] Inventors: Hermann Müller, Munich; Dieter Sandl, Ottobrunn; Jürgen Sylla, Munich; Rolf Schröder, Baldham, all of Germany

[73] Assignee: AGFA-Gevaert, A.G., Leverkusen, Germany

[22] Filed: Nov. 26, 1974

[21] Appl. No.: 527,288

[30] Foreign Application Priority Data

Nov. 28, 1973 Germany ..... 2359363

[52] U.S. Cl. ..... 156/506; 156/159; 156/304

[51] Int. Cl.[2] ..... B31F 5/00; B65H 19/00; G03D 15/04

[58] Field of Search ..... 156/157, 159, 256, 304, 156/502, 505, 506, 517

[56] References Cited

UNITED STATES PATENTS

| | | | |
|---|---|---|---|
| 3,537,940 | 11/1970 | Nagano | 156/505 |
| 3,546,046 | 12/1970 | MacQueston | 156/505 |
| 3,607,571 | 9/1971 | Tange | 156/505 |
| 3,716,444 | 2/1973 | Hanke | 156/505 |
| 3,833,447 | 9/1974 | Gustafson | 156/505 |

*Primary Examiner*—Charles E. Van Horn
*Assistant Examiner*—John E. Kittle
*Attorney, Agent, or Firm*—Michael J. Striker

[57] ABSTRACT

One end of each film strip is engaged, and an adhesive film splice having a release paper which must be pulled off, is also engaged. In a single operation, resulting from the displacement of two components relative to one another, the overlapped ends of the film strips are cut, the release paper is pulled off the film splice, and the latter is pressed over the joint between the film strips to splice them together.

26 Claims, 7 Drawing Figures

METHOD OF AND APPARATUS FOR SPLICING THE ENDS OF FILM STRIPS

BACKGROUND OF THE INVENTION

The present invention relates generally to the splicing-together of film strip ends, and more particularly to a method of effecting such splicing and to an apparatus for carrying out the method.

The ends of film strips are usually spliced together by means of a self-adhesive foil or film splice which is covered by one or more release papers that must be pulled off to expose the adhesive, whereupon the film splice is placed over the adjacent ends of the film strips and pushed onto them so as to adhere. This is done in film presses in which the individual operations are carried out in sequence and individually. The difficulty with this approach is that as every step in making the splice must be carried out individually, the user must pay close attention at all times, which is quite frequently not the case. Moreover, the user must be skilled in carrying out the individual manipulations in order to obtain a film splice of satisfactory quality, and this also is often a requirement that cannot be met because the users frequently are amateurs who have no skill in manipulating this type of equipment.

SUMMARY OF THE INVENTION

It is, accordingly, an object of the present invention to overcome the disadvantages of the prior art.

More particularly, it is an object of the present invention to provide an improved method of forming a film splice, wherein the aforementioned disadvantages are overcome.

Another object of the invention is to provide an improved apparatus for carrying out the method which is very simple to operate and in which the quality of the film splice obtained is more or less independent of the skill of the user.

In keeping with these objects, and others which will become apparent hereafter, one feature of the invention resides in the novel method, according to one aspect of which one end of each film strip is engaged, and an adhesive film splice having a release paper covering its adhesive is also engaged. Thereupon, and in a single operation, the film strip ends are overlapped, they are cut through to form a butt joint, the release paper is stripped from the adhesive film splice, and the latter is adhered to the ends so that it straddles the butt joint and connects the film strips.

The various operations are all carried out by movable components of the film press, but the entire sequence of movement of all of the movable components is controlled by effecting relative movement of only two elements of the film press, for instance an upper and a lower part of the film press that are hinged so that they can be folded together and apart in the manner in which one opens and closes a book.

It is advantageous if the movement of the components is controlled by at least one control member that is slidable and moves when the film press is folded together, and which is advantageously moved by motion transmitting means, for instance a pull strap, connected to the hinge of the two doubly movable elements.

The film strips are advantageously held in place on a silde member and are cut through by a cutting device which is movable to cutting position, whereupon the slide member with the film is advanced to a splicing station, while during such advancement the release paper or papers is pulled off the film splice, so that the latter can be pushed against the abutted film strip ends when the latter arrive at the splicing station.

It is advantageous if the removal of the release paper, of which there are usually two parts provided, is effected by means of two hooks which engage in cutouts provided for this purpose in the release paper, and which move in mutually opposite directions and with reference to the film splice when the movable elements of the film press are moved relative to one another, to closed position. If the release papers are not formed with such cutouts, then pointed hooks may be provided which penetrate the release papers, or clamping devices may be provided which engage the release papers.

In the splicing station the remaining self-adhesive foil constituting the film splice is pushed against the abutted film strip ends, is then folded around the edges of the film strips which are formed with sprocket holes, and is rolled onto the film strips at both sides by means of rollers.

It is advantageous if the film press according to the present invention is constructed so that its upper and lower parts can be hingedly moved relative to one another between an open and a closed position, in a manner analogous to the opening and closing of a book, as outlined earlier. Sector-shaped projections may be provided on the upper and lower parts extending normal to pivot axis thereof, and the peripheries of the sector-shaped projections may have pull straps secured and guided on them. The sector-shaped projections may have an outer side which is concentric with reference to the pivot axis, or they may have an outer side having a varying curvature. In the latter case, the variable amount of force required to close the film press and effect the execution of the sequence of operations, can be more readily taken into account.

The two ends of each of the pull straps may advantageously be connected to control members which are slidable relative to the upper and lower parts of the film press, respectively, and which are biased by springs against the edges of these parts that are remote from the pivot axis, the biasing taking place in direction counter to the pull to be exerted by the pull straps. An additional slide member may be provided at the upper part of the press an may be urged against an abutment by means of a spring; this slide member may be provided with a receiver for the film splice. The slide member connected with the pull strap or straps is advantageously provided with a hook to engage the release paper of the film splice, and the upper part of the press may have a fixedly mounted hook which engages the other release paper of the film splice.

The lower part of the film press may have a slide member mounted thereon which is urged against an abutment by means of a spring, counter to the direction of pull exerted by the pull strap. This slide member is provided with a receiver for the film ends that are to be spliced together. The lower part of the film press also has a spring biased arm which is turnable by means of a control cam on the slide member. On opposite sides of the plane in which the film strip ends are located, there are pressure rollers mounted stationarily in the upper and lower parts of the film press, respectively.

To cut through the film strip ends the lower part of the film press is provided with a two-part cutting device which is spring mounted and can be coupled with the control member by means of a pawl so that it can be pulled against an abutment in the direction of pull exerted by a pull strip, and will then close when it engages the abutment.

A further embodiment of the invention provides a different film press which again has an upper and a lower part that can be opened and closed in the manner of a book, and wherein the upper part is provided at the hinge with a segment-shaped projection at the periphery of which a pull strap is mounted and guided. The opposite end of the pull strap is connected to a slide member which controls the movement of a further slide member that carries the film strips whose ends are to be connected. This second slide member is provided with a receiver for the film splice and with two pins which extend through two perforations of the film splice. It is advantageous if a holding arm is provided which is turnable about the hinge axis of the upper and lower parts and which moves together with the upper part; this holding arm may be provided with a projection which, when the upper and lower parts are moved to closed condition, urges the film splice against the film strip ends. The receiver may be provided with a pin which extends through a center opening of the film splice that expose two perforation or sprocket holes of the film. A two-part cutter is provided which is movable and actuatable by means of the slidable control member, and one of the parts of the cutter has a hook which engages a release paper of the film splice.

The film splice for carrying out the present invention advantageously has a common cutout for two sprocket or perforation holes at the center, and one cutout each for a respective sprocket or perforation hole at the margin.

The novel feature which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
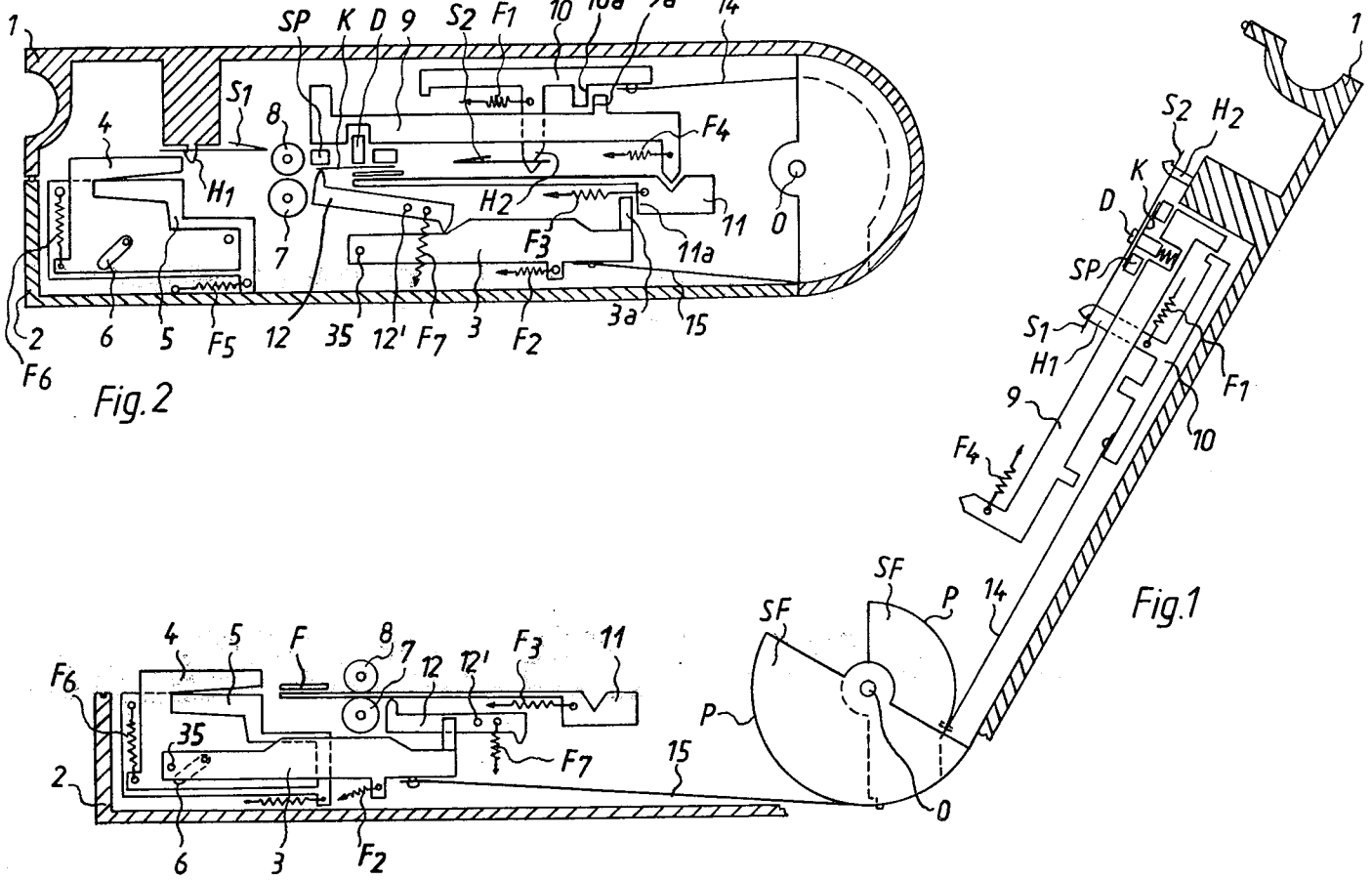
FIG. 1 is a slightly diagrammatic section showing a film press according to the present invention in open condition.
FIG. 2 shows the film press of FIG. 1 in closed condition.

Referring firstly to FIGS. 1 and 2 it will be seen that the film press illustrated therein has two parts 1 and 2 which can be pivoted about an axis 0 to open and closed position in the manner of a book. The parts 1 and 2 are provided with segment-shaped projections SF formed at their hinges. The periphery P of these projections SF has pull straps 14, 15 connected thereto which in the closed position of the press (see FIG. 2) overlie the outer side or periphery P of the respective projection SF. One end of each pull strap is connected; to the respective projection SF. The second end of the pull strap 15 of the lower part 2 is connected to a slide member 3 which is urged by a spring 2 opposite to the direction of pull exerted by the pull strap 15. A further slide member 11 is urged by a spring $F_3$ counter to the direction of pull exerted by the strap 15, and also in the lower part 2. The film F, which extends to the plane of FIG. 1, is retained in known manner on the slide member 11 in readiness for having its ends spliced together.

Located at opposite sides of the film F are pressure rollers 7, 8. An arm 12 is turnably mounted about the pivot 12′ and is urged by a spring $F_7$ so that one end of the arm engages the slide member 11.

Located in the forward portion of the part 2 is a cutting unit which is horizontally shiftable and composed of two blades 4, 5 which are spring biased apart from one another. The blade 4 is vertically displaceable and is provided with a pawl 6 which is engaged by a pin 35 of the slide member 3.

The open upper part 1 of the press has a slide member 10 which is biased by a spring $F_1$ counter to the direction of pull exerted by the pull strap 14. In addition it has a further slide member 9 which is biased by the tension spring $F_3$. The slide member 9 has springy projections or pins D as well as a support SP of synthetic plastic foam material on which in known manner a self-adhesive film splice foil K having the protective release papers $S_1$ and $S_2$ is mounted. The pins D are retractable in sleeves. The release papers $S_1$ and $S_2$ have hooks $H_1$ and $H_2$ hooked into them, for which purpose they are provided with cutouts. However, if there are no cutouts then the hooks would be provided with sharp tips which would pierce the release papers.

The press of FIG. 1 is shown in closed condition in FIG. 2, that is a condition in which the splicing operation is half completed. The slide members 3 and 10 are in the position in which they are located adjacent to the hinge; the slide member 11 engages with its abutment 11*a* a corresponding abutment 3*a* of the slide member 3, and the slide member 9 has its abutment 9a in engagement with the abutment 10*a* of the slide member 10. The release papers $S_1$ and $S_2$ are hooked onto the hooks $H_1$ and $H_2$, the self-adhesive foil K has one half pushed onto the film F whereas the other half adheres to the upper arm of the lever 12.

The operation of the film press in FIGS. 1 and 2 is as follows:

The starting position of the film pressis the one shown in FIG. 1. In this position the film F is placed onto the slide member 11 and the film splice K onto the slide member 9. Thereupon the film press is moved to the closed position shown in FIG. 2, and as a result of this relative movement of upper and lower parts 1, 2 of the film press the tension straps 14 and 15 move the slide members 10 and 3 in the direction towards the axis O. The slide member 3 which in the open position (FIG. 1) of the film press is coupled with the pawl 6 draws the cutting unit having the blades 4 and 5 against the roller 7. The pressure resulting from engagement with such abutment on the pawl 6 that is mounted in an inclined position on the blade 4, effects pivoting of the blade 4 in downward direction so that the film F is cut through, whereby the two film ends form a butt joint.

Before the slide member 3 engages the slide member 11 the cutting unit having the blades 4, 5 becomes detached from the slide member 3 and is returned to its starting position by the spring $F_2$.

The slide member 10 pulls the release paper $S_1$ off the film splice K, and after it abuts the slide member 9 the latter moves with slide member 10, and therefore the film splice K on the slide member 9 moves also. This causes the release paper $S_2$ which is engaged by the hook $H_1$ of the upper part 1 to be pulled off the splice K. When the press is completely closed, the splice K has one half of its pressed against the film F by the support SP, whereas the other half engages with a small portion of its surface the arm 12 that is moved into position by the slide member 3. During the subsequent opening of the press the various components retract in reverse sequence from the one described, and during this movement that half of the splice K which adheres the arm 12 is pulled downwardly. Due to the movement of the slide member 11 in the direction of the rollers 7, 8 the splice K is detached again from the arm 12, held down by the roller 7 and subsequently pressed by the same against the underside of the film F. After the press has again been fully opened (to the position of FIG. 1) the spliced film can be removed.

Figures 3, 4A:
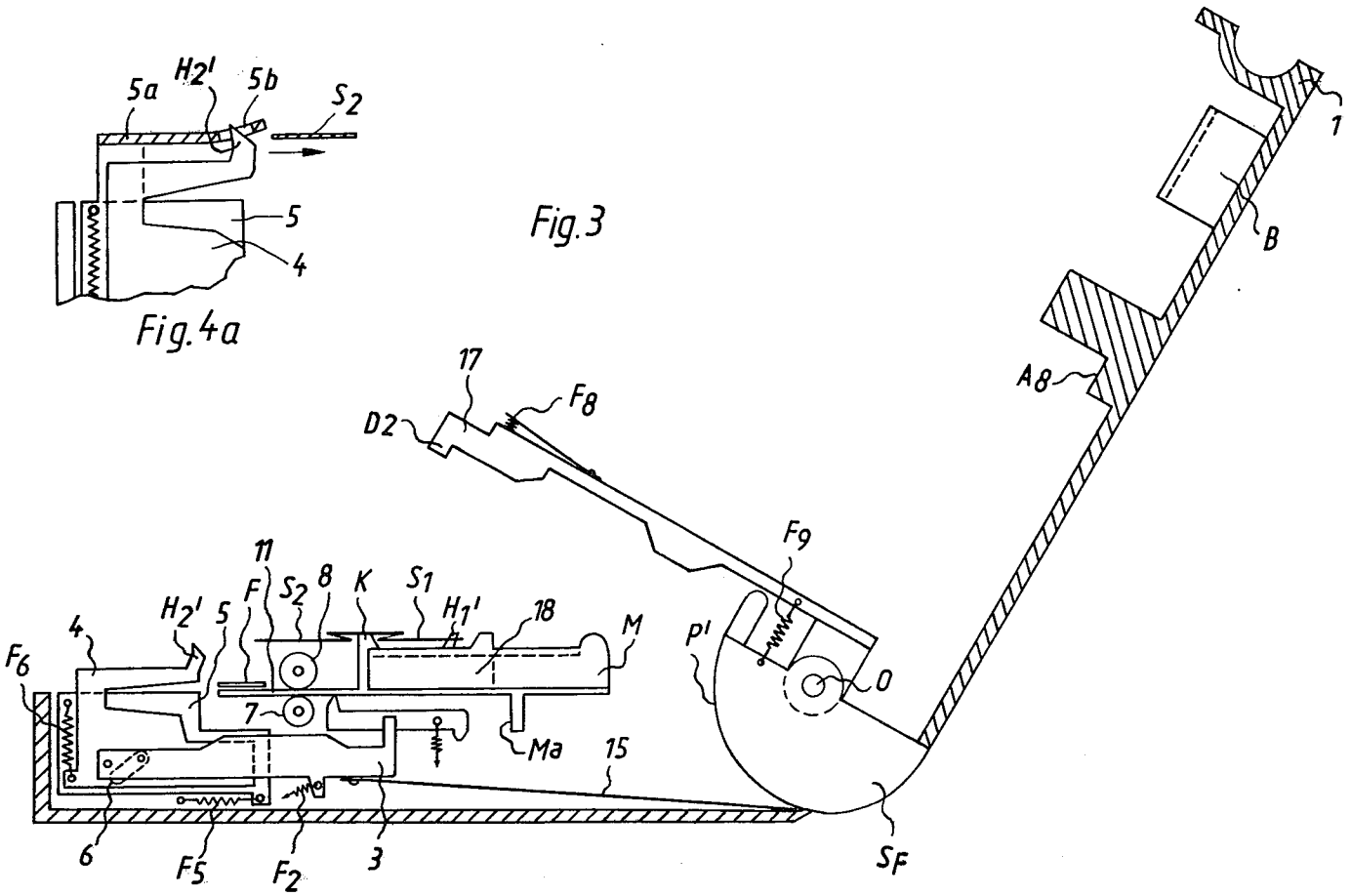
FIG. 3 is a view similar to FIG. 1 but of a different embodiment of the invention.
FIG. 4*a* is a fragmentary sectioned detail view, illustrating a detail of a particular embodiment of an arrangement for pulling a release paper off the film splice.
Figure 4:
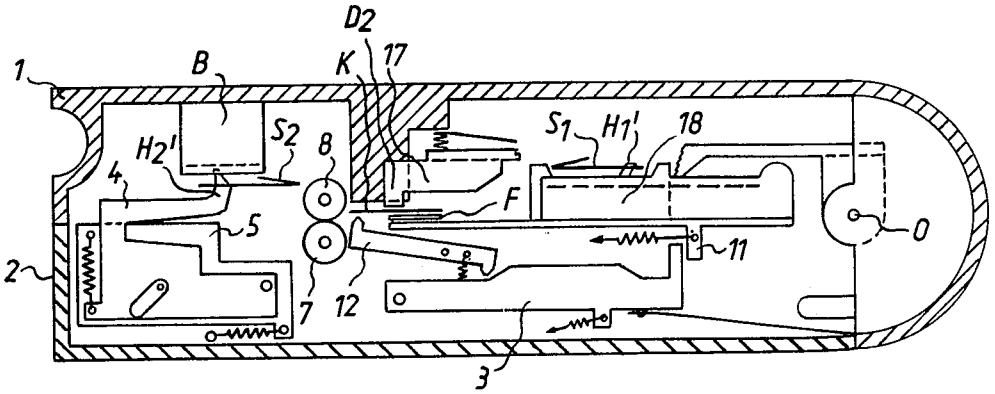
FIG. 4 is a view similar to FIG. 2 but of the embodiment of FIG. 3.

A further embodiment of the invention is illustrated in FIGS. 3 and 4. Its essential difference from the embodiment in FIGS. 1 and 2 is that the upper part 1 of the film press does not contain any slide members. For this reason, only the upper part 1 is formed with a sector-shaped projection SF which may have a periphery that is concentric with reference to the pivot axis O (this can also be employed in the embodiment of FIGS. 1 and 2), or which can have a varying curvature (this also can be employed in the embodiment of FIGS. 1 and 2). The use of a varying curvature for the periphery P has the advantage that the differential force requirements during closing of the press can be taken into account by varying the length of the lever arm.

An arm having a projection $D_2$ is mounted on the pivot axis O and is spring biased by the spring $F_8$ and pulled downwardly by the spring $F_9$. The slide member 11 is formed with a receiver 18 for the film splice K having the release papers $S_1$ and $S_2$, of which $S_2$ is engaged by the hook $H_1$. The hook $H_2$ is constructed as a part of the blade 4.

The closed condition of the press of FIGS. 3 and 4 is illustrated in FIG. 4; in this position the release paper $S_2$ is engaged by the hook $H_2'$the tip of which can engage into a slot formed in a pressure member B. The adhesive foil of the splice K is pressed against the film F by projection $T_2$ of the arm 17.

In FIG. 4*a* we have illustrated a somewhat different embodiment of the arrangement for engaging the release paper. The fixed portion 5 of the cutting device here has a projection 5*a* which is formed with an opening 5*b* into which the hook $H_2'$ opens when the cutting device is in open position, as illustrated. When the blade 4 is pivoted in the cutting station, the tip of the hook $H_2'$ is moved out of the opening 5*b* and the release paper $S_2$ moves between this tip and the projection 5*a*, so that during the return movement of the cutting unit the hook pierces the release paper and takes it along.

It will be understood that in place of the hooks that have been described thus far, which either engage in existing cutouts in the release papers or make their own holes therein, appropriate clamping devices could also be employed. For instance, in FIG. 4*a* it would merely the necessary to eliminate the opening 5*b* and to make the hook with a dull end rather than with a pointed end, in order to obtain clamping of the release paper. In such a case care must be taken, however, that the surfaces which come in contact with the slippery release paper are sufficiently rough to obtain a reliable clamping and taking along of the release paper.

The operation of the embodiment in FIGS. 3 and 4 is largely the same as in FIGS. 1 and 2. It differs only in certain respects. When the press is closed and the film F is in place as is the film splice K, the arm 17, or rather the projection $D_2$, extends into sprocket holes of the film splice K and holds the latter under the influence of the spring $F_9$. When the slide member 3 is shifted in direction toward the hinge the cutting device 4, 5 initially travels along with it and the hook $H_2'$ engages through the release paper $S_2$. When the slide member 3 disengages the cutting device the release paper $S_2$ is pulled off. During further closing of the press of the abutment 3*a* of the slide member 3 takes along the slide member 11, and the release paper $S_1$ is pulled off by the hook $H_1'$. During the final closing movement of the parts 1 and 2 the arm 17 is pressed via the abutment $A_8$ and the spring $F_8$ against the film splice K, and the latter is thereby pressed against the film F. The further operation is the same as described with respect to FIGS. 1 and 2.

Figure 5:
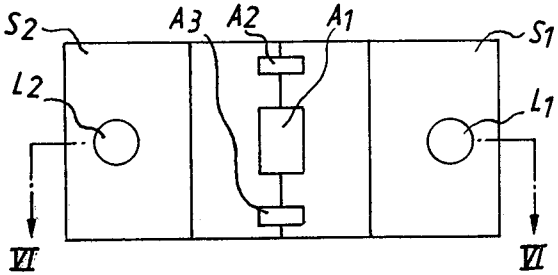
FIG. 5 is a plan view of a film splice for use in carrying out the present invention.
Figure 6:
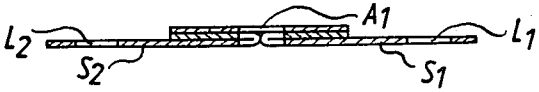
FIG. 6 is a section through FIG. 5.

In FIG. 5 we have illustrated in plan view a somewhat modified film splice which can be advantageously used in the embodiments described herebefore. It differs from conventional film splices only insofar as it is formed at the center with a cutout which leaves free both of the sprocket holes of the film that are ajacent to the butt joint. Tests have shown that in such an arrangement the film splice is not of lower quality than the prior art and that sound films that are formed with a marginal sound track will operate much better if they have been spliced with the splice according to FIG. 5 than with the prior art splices. The reason for this is that the prior art splices tend to become disengaged from the film at the joint between the two butted film ends, which leads to a thickening of the joint and to difficulties during projecting of the film. This large center cutout is identified with reference numeral $A_1$ and if the film splice of FIGS. 5 and 6 is for example used in the press of the embodiment in FIGS. 3 and 4 the projection $D_1$ may extend through the cutout $A_1$, whereas the projection $D_2$ can extend through the two smaller cutouts $A_2$ and $A_3$, or vice versa. The holes $L_1$ and $L_2$ in the release papers may be omitted if hooks having pointed tips are used, such as hooks $H_1$, $H_2$ or $H_1'$ and $H_2'$, which can make their own holes.

It will be understood that various modifications are possible in the illustrated exemplary embodiments. For example, components of one of the embodiments in FIGS. 1, 2 and 3, 4 may be replaced with components of the other embodiment, to name just one example.

It will be understood that each of the elements described above, or two or more together, may also find a useful application in other types of constructions differing from the types described above.

While the invention has been illustrated and described as embodied in a film press, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for making a splice joint at the ends of a pair of film strips, comprising a film press having two parts which are hinged-together for relative swinging movement about an axis between an open position and a closed position; first means on said press for holding said ends of said film strips in overlapping relationship with each other; second means on said press for holding a self-adhesive film splice having a release paper; and third means, also on said press and actuated by relative movement of said parts from said open to said closed position, for sequentially cutting through said overlapped film ends to form a butt joint, stripping said release paper from said film splice, and pressing said film splice over said butt joint, so that the splice joint is completed and the film ready for removal from said press prior to subsequent relative movement of said parts from said closed position back to said open position.

2. An apparatus as defined in claim 1, wherein a pair of sector-shaped components project from said elements normal to said axis, and motor transmitting straps are secured and guided on the peripheries of said sector-shaped components.

3. An apparatus as defined in claim 2 wherein said components each have an outer side concentric with said axis.

4. An apparatus as defined in claim 2, each of said straps having two ends; further comprising a pair of slidable control members shiftable relative to said two parts, respectively, and each having one of said two ends secured thereto; and spring means urging said control members toward a side of said parts which is remote from said axis.

5. An apparatus as defined in claim 4, wherein an upper one of said parts includes a further slidable control member, and a spring urging the same into contact with an abutment.

6. An apparatus as defined in claim 5, wherein said further slidable control member includes a receiver for said film splice.

7. An apparatus as defined in claim 6, wherein one of said slidable control members connected to said pull straps has a hook for engagement with the release paper of said film splice.

8. An apparatus as defined in claim 6, wherein said upper part is provided with a hook for engagement with said release paper of said film splice.

9. An apparatus as defined in claim 4, wherein a lower one of said parts includes a slide, and a spring urging said slide counter to the direction of movement of one of said slidable control members and against an abutment provided on the latter.

10. An apparatus as defined in claim 9, wherein said slide includes a receiver for the film ends to be spliced.

11. An apparatus as defined in claim 4, wherein said lower part includes a spring-biased turnable lever, and one of said slidable control members has a cam engageable with said lever for turning the same.

12. An apparatus as defined in claim 2, wherein said film ends are arranged in a plane; and further comprising a pair of film-pressing rolls mounted at opposite sides of said plane in the respective parts.

13. An apparatus as defined in claim 4, wherein a lower one of said parts includes a spring-biased two-part cutting blade movable to and from a closed position, and a pawl for operatively connecting said blade with one of said slidable control members so that it moves in the direction in which the connected to said control member exerts tension.

14. An apparatus as defined in claim 2, wherein said parts are an upper and a lower part, and wherein said upper part includes a segment-shaped projection having a periphery on which one end of one strap is mounted and guided.

15. An apparatus as defined in claim 14, wherein another end of said one strap is connected to a slidable control member having a receiver for the film splice.

16. An apparatus ad defined in claim 15, wherein said receiver has two pins which extend through apertures formed in said film splice.

17. An apparatus as defined in claim 16; further comprising an arm turnable about said axis together with said upper part and formed with an extension which in the closed position of said upper and lower parts urges said film splice against said film ends.

18. An apparatus as defined in claim 15, wherein said receiver has a pin which extends through a center aperture of said film splice.

19. An apparatus as defined in claim 15; further comprising a two-part cutting blade activatable by movement of said slidable control member and including a hook engageable with a release paper of said film splice.

20. An apparatus as defined in claim 2, wherein said component each has an outer surface extending circumferentially of said axis and having a non-uniform curvature.

21. An apparatus as defined in claim 1, wherein said third means comprises a film-cutting device for cutting through said overlapped film ends at a cutting station; and further comprising transporting means for transporting said film strips subsequent to cutting by said device from said cutting station to a splicing station where said film splice is pressed over said butt joint.

22. An apparatus for making a splice joint at the ends of a pair of film strips, comprising support means including a base, an arm and means mounting said arm to said base for swinging movement between a first position in which said arm overlies said base and a second position; means for retaining a pair of film strips on said support means so that their respective end portions overlap one another; means for holding a self-adhesive film splice having a release paper; means for cutting through said overlapped end portions in response to movement of said arm from said second position towards said first position, so as to form a butt joint; means for stripping said release paper from said film splice during said movement of said arm towards said first position; and means for pressing said film splice over said butt joint subsequent to stripping of said release paper and as said arm approaches said first position, so that the splice joint is completed when said arm is in said first position and the spliced film is ready for removal upon reversal of the movement of said arm from said first towards said second position.

23. An apparatus as defined in claim 22, wherein said retaining means comprises a carriage mounted on said base and movable between a first and a second station at which holds said film strips in readiness for said cutting means and said pressing means, respectively, and further comprising connecting means connecting said carriage with said arm for effecting movement of said carriage from said first to said second station in response to movement of said arm from said second towards said first position thereof.

24. An apparatus as defined in claim 23, wherein said holding means projections carried by said arm and engageable with a respective film splice.

25. An apparatus as defined in claim 22, wherein said stripping means comprises hooks carried by said arm.

26. An apparatus as defined in claim 22, wherein said pressing means presses one half of said film splice over one major surface of said film strips at said butt joint, said pressing means further comprising means for folding the other half of said film splice about a lateral edge of said film strips and for pressing said other half over the other major surface of said film strips at said butt joint.

* * * * *